US011828043B2

(12) United States Patent
Fredrickson et al.

(10) Patent No.: US 11,828,043 B2
(45) Date of Patent: Nov. 28, 2023

(54) MANUAL INPUT DEVICE AND METHOD

(71) Applicant: Caterpillar Inc., Peoria, IL (US)

(72) Inventors: Andrew A. Fredrickson, Holly Springs, NC (US); Stuart R. Spencer, Cary, NC (US); Sage F. Smith, Apex, NC (US); Gareth Jones, Cary, NC (US)

(73) Assignee: Caterpillar Inc., Peoria, IL (US)

( * ) Notice: Subject to any disclaimer, the term of this patent is extended or adjusted under 35 U.S.C. 154(b) by 142 days.

(21) Appl. No.: 17/129,206

(22) Filed: Dec. 21, 2020

(65) Prior Publication Data

US 2022/0195697 A1 Jun. 23, 2022

(51) Int. Cl.

| | |
|---|---|
| ***E02F 9/20*** | (2006.01) |
| ***G05G 1/06*** | (2006.01) |
| ***G05G 9/04*** | (2006.01) |
| ***G05G 9/047*** | (2006.01) |

(52) U.S. Cl.

CPC ..... *E02F 9/2004* (2013.01); *G05G 1/06* (2013.01); *G05G 9/047* (2013.01); *G05G 2009/04774* (2013.01)

(58) Field of Classification Search

CPC ..... G05G 1/06; G05G 9/047; G05G 9/04785; G05G 2009/04774; E02F 9/2004

See application file for complete search history.

(56) References Cited

U.S. PATENT DOCUMENTS

| | | | | | |
|---|---|---|---|---|---|
| RE24,701 | E | * | 9/1959 | Redmond | G05G 1/06 318/580 |
| 3,198,922 | A | * | 8/1965 | Rohacs | G05G 1/06 16/334 |
| 4,584,510 | A | * | 4/1986 | Hollow | G05G 9/047 250/221 |
| 5,512,892 | A | * | 4/1996 | Corballis | G05G 9/047 341/20 |

(Continued)

FOREIGN PATENT DOCUMENTS

| | | | |
|---|---|---|---|
| DE | 102014214989 | A1 | 6/2020 |
| EP | 0545832 | A1 * | 6/1993 |

(Continued)

OTHER PUBLICATIONS

Written Opinion and International Search Report for Int'l. Patent Appln. No. PCT/US2021/059662, dated Feb. 23, 2022 (16 pgs).

*Primary Examiner* — Adam D Rogers

(74) *Attorney, Agent, or Firm* — Bookoff McAndrews, PLLC

(57) ABSTRACT

A manual input device for a machine includes an elongate handle rigidly connected at one end to a frame of a machine and configured to be engaged by a hand of an operator, and a control portion connected to a free end of the elongate handle. The control portion includes a first plurality of control surfaces and a second plurality of control surfaces associated with sensors providing control signals. The first plurality of control surfaces is positioned and oriented relative to the handle portion so it is accessible for interac- (Continued)

tion by a thumb of the hand of the operator, and the second plurality of control surfaces is positioned and oriented relative to the handle portion so it is accessible for interaction by an index finger of the hand of the operator.

20 Claims, 6 Drawing Sheets

(56) References Cited

U.S. PATENT DOCUMENTS

| | | | | |
|---|---|---|---|---|
| 7,334,658 | B2 * | 2/2008 | Berg | E02F 9/2004 180/333 |
| 7,474,296 | B2 | 1/2009 | Obermeyer et al. | |
| 8,069,927 | B2 | 12/2011 | Bachstein | |
| 8,276,476 | B2 | 10/2012 | Diccion | |
| D753,118 | S * | 4/2016 | French | D15/28 |
| 9,342,091 | B2 | 5/2016 | Wuisan et al. | |
| 10,035,583 | B2 * | 7/2018 | Scofield | B64C 27/57 |
| 10,036,139 | B2 * | 7/2018 | French | E02F 3/844 |
| 10,042,382 | B2 | 8/2018 | Astrom et al. | |
| 10,088,915 | B2 * | 10/2018 | Drum | G06F 3/0354 |
| 10,120,407 | B2 * | 11/2018 | Niguet | G05G 25/04 |
| 10,145,084 | B2 * | 12/2018 | Fredrickson | E02F 3/3414 |
| 10,198,086 | B2 | 2/2019 | Parazynski et al. | |
| 10,591,948 | B1 * | 3/2020 | Culp | B64C 27/56 |
| 10,633,022 | B2 * | 4/2020 | Johnson | B60K 37/06 |
| 11,231,738 | B2 * | 1/2022 | Izzo | H01H 9/167 |
| 2005/0034549 | A1 * | 2/2005 | Braud | B66F 9/20 74/543 |
| 2009/0012659 | A1 * | 1/2009 | McMahon | B64C 13/0421 244/236 |
| 2012/0036956 | A1 * | 2/2012 | Klein | E02F 9/2004 74/471 R |
| 2016/0304180 | A1 | 10/2016 | Steven | |
| 2020/0012309 | A1 * | 1/2020 | Wuisan | G05G 9/047 |
| 2022/0057826 | A1 * | 2/2022 | Lawniczak | G05G 5/03 |

FOREIGN PATENT DOCUMENTS

| | | | | |
|---|---|---|---|---|
| EP | 1353257 | A1 * | 10/2003 | |
| EP | 1717187 | B1 | 1/2013 | |
| EP | 3115863 | A2 * | 1/2017 | |
| EP | 2381331 | B2 | 6/2019 | |
| JP | 11338568 | A | 12/1999 | |
| JP | 2012-234278 | A | 11/2012 | |
| KR | 20140086942 | A * | 7/2014 | |
| WO | WO-2009048364 | A1 * | 4/2009 | E02F 9/2004 |
| WO | WO-2020046436 | A1 * | 3/2020 | |

* cited by examiner

MANUAL INPUT DEVICE AND METHOD

FIELD OF THE DISCLOSURE

The present disclosure is applicable to manual control devices and, more particularly, to joystick-type manual devices for use in controlling machines.

BACKGROUND

Manual control devices are commonly used to control machines. For example, various machine types such as airplanes, cranes, each-moving machines and the like use joystick-type input devices that are manipulated by a machine operator to control the motion and/or functions of the machine. In the typical fashion, an operator grasps a handle portion of the input device and moves it to provide control inputs to the machine. The handle portion of usually mounted onto the machine through a multi-axial pivoting mechanism that permits displacement and/or rotation motion of the handle relative to a base in or along one or more axes. Sensors are placed on the base of the handle to provide control signals indicative of the motion or displacement of the handle to a controller, which controller then translates those signals into machine commands. In such a control arrangement, which is sometimes referred to as a fly-by-wire arrangement, electrical signals generated by sensors on the handle of the machine that is manipulated by the operator provide the command inputs to control motion and/or other operations of the machine. The handle portion of the manual control device may further include other control inputs such as buttons and triggers, which the operator may selectively activate, for example, using the operator's index finger, thumb, or other digits, to control various other functions of the machine.

In certain applications, for example skid-steer loaders, and in other machines in which the operator may be standing during machine operation, such as forklifts, abrupt motion of the machine may cause the operator to lose balance and/or abruptly move or jerk with the machine. In those application, operator restraints such as belts and/or handles, are provided to permit the operator to stabilize themselves against excessive motion relative to the machine. However, in most applications, such solutions are only partially effective in stabilizing the operator without compromising the operator's ability to effectively control the machine.

One previously proposed solution for providing a manual control device to an operator can be seen in U.S. Pat. No. 7,474,296 to Obermeyer et. al. ("Obermeyer"). Obermeyer describes a multi-axis position transducer that is associated with a fingertip operated grip, which is similar to a trackball, that is connected to a hand held grip. The fingertip operated grip includes sensor means to provide motion signals. During use, the hand held grip stabilizes the user's hand relative to the fingertip operated grip, which is in turn operated by the user's index finger, middle finger and thumb, as shown in Obermeyer's FIG. 36A. While Obermeyer's device is at least partially effective in providing a stable platform for the user's hand in operating a fingertip control, it provides limited opportunity to control multiple functions, as would be required for a more complex machine, and is also susceptible to contamination from dirt or other debris, which might be present in certain applications. Moreover, the user's dexterity in manipulating the fingertip control input would be difficult if the user were wearing gloves or was operating in a high vibration environment.

BRIEF SUMMARY OF THE DISCLOSURE

In one aspect, the disclosure describes a machine. The machine includes, among other, a frame, a controller associated with the frame, and an operator station disposed on the frame. The operator station is adapted to be occupied by an operator during operation of the machine. A manual input device is connected to the frame adjacent the operator station. The manual input device is configured to be engaged by a hand of the operator. The manual input device includes a handle portion having an elongate shape rigidly connected to the frame, and a control portion connected to one end of the handle portion. The control portion includes a first plurality of control surfaces and a second plurality of control surfaces. The first plurality of control surfaces and the second plurality of control surfaces are associated with sensors providing control signals to the controller. The first plurality of control surfaces is accessible for interaction by a thumb of the hand of the operator, and the second plurality of control surfaces is accessible for interaction by an index finger of the hand of the operator.

In another aspect, the disclosure describes a manual input device for a machine. The manual input device includes a handle portion having an elongate shape, the handle portion having one end configured to be rigidly connected a frame of a machine. The handle portion is configured to be engaged by a hand of an operator. The manual input device further includes a control portion connected to the handle portion. The control portion includes a first plurality of control surfaces and a second plurality of control surfaces, the first plurality of control surfaces and the second plurality of control surfaces being associated with sensors providing control signals to a controller. The first plurality of control surfaces is positioned and oriented relative to the handle portion so it is accessible for interaction by a thumb of the hand of the operator, and the second plurality of control surfaces is positioned and oriented relative to the handle portion so it is accessible for interaction by an index finger of the hand of the operator.

In yet another aspect, the disclosure describes a method for operating a machine. The method includes occupying an operator station of a machine with an operator, using at least one hand of the operator to grab a handle portion of a control device, the handle portion of the control device being rigidly connected to a frame of the machine, wherein grabbing the handle portion operates to stabilize the operator relative to the machine and wherein grabbing the handle portion involves grasping the handle portion in a palm of the operator using at least two fingers wrapped around the handle portion, activating a first plurality of control surfaces disposed on a control portion that is connected onto a free end of the handle portion using a thumb of the operator, and activating a second plurality of control surfaces disposed on the control portion using an index finger of the operator.

DETAILED DESCRIPTION

Figure 1:
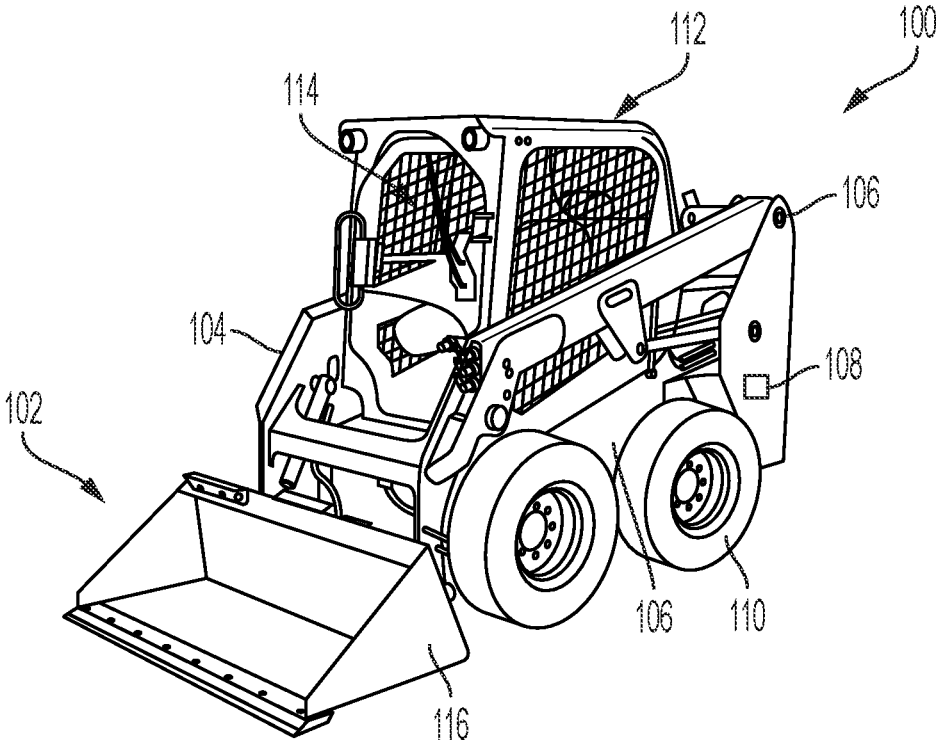
FIG. 1 is an outline view of an exemplary embodiment for a machine in accordance with the disclosure.

In general, the present disclosure relates to a manual control device or input device for use by a machine operator to locally or remotely control the motion and operation of a machine and also the operation and/or configuration of one or more work implements connected to or associated with the machine. While the illustrated embodiment is described in the context of a skid-steer machine, having a loader bucket attached, it should be appreciated that other machine types such as mini-skid steer machines, forklifts and the like that are locally or remotely controlled are contemplated. In one embodiment, the disclosure describes a manual control input device, joystick, or electronic handlebar controller for controlling multiple functions of multiple machines. The electronic handlebar controller allows the operator to maintain at least a two, three or four finger grip around each of one or two handlebars while controlling the primary machine functions with the thumbs and/or fingertips. Additionally, the operator can operate secondary control inputs within reach of the thumbs and/or fingers. For example, a miniature joystick similar to one found on a video game controller is placed within finger reach of the handlebar.

In one embodiment, a pair of handlebar controllers is placed on a machine such as a skid steer loader. The pair includes a left and right handlebar disposed on either side of an operator seat for operation by the operator's left and right hands. In an exemplary embodiment, the left joystick operates drive functions of the loader and the right joystick operates work implement functions of a work implement connected to the machine. This setup allows a four-finger grip on both hands. If an additional, simultaneous function is desired, an electronic input could be added near the forefinger of each hand, and this would still allow for a three-finger grip. A grip sensor or dead-man switch can be added to ensure that the operator is gripping the controls while the machine is moving or the work implement is performing functions to avoid damage or injury to the machine or its surroundings.

The operator can maintain a firm grasp on the machine while simultaneously operating numerous functions to their full capacity, and since the hands are used to brace against machine acceleration, inadvertent control inputs through the fingers are minimized or avoided. Further, by anchoring the operator's hands on the handlebar in proximity to the control switches and surfaces, relative motion between the palms and the fingertips is minimized to optimize control accuracy of the machine's motion and operation.

The proposed controllers differ from similar joysticks in the market in that other joysticks have hand grips that pivot the entire hand about a base part. The proposed design has a hand grip that has no motion relative to the machine. The control inputs are operated exclusively by the fingers and thumbs, not by the wrists and/or forearms. The hand grip can be connected to a machine frame at either or both ends, and includes a control portion onto which switches and other control surfaces are placed for fingertip access by the operator.

An exemplary embodiment for a machine 100 is shown in FIG. 1. The machine 100 shown is a skid-steer loader having a loading bucket 102 as its work implement connected to swing arms 104 that are pivotally attached to a chassis 106. The chassis 106 includes an engine (not shown) and a controller 108 that controls various functions including motion of the machine by rotation of ground engaging members 110 or wheels, motion of the swing arms 104, operation of a work implement, for example, planers, mowers, augers, snow blowers, and other implements that are connectable to the swing arms 104 in place of the bucket 102. Work implements having active and/or moving parts can interface with the swing arms 104 and the controller 108 through a multi-tool interface 116, which provides both mechanical and electronic communication connection of the implement to the remaining portions of the machine 100, including information about the functions of the implement and the control inputs required to control those functions with the controller 108.

Figure 2:
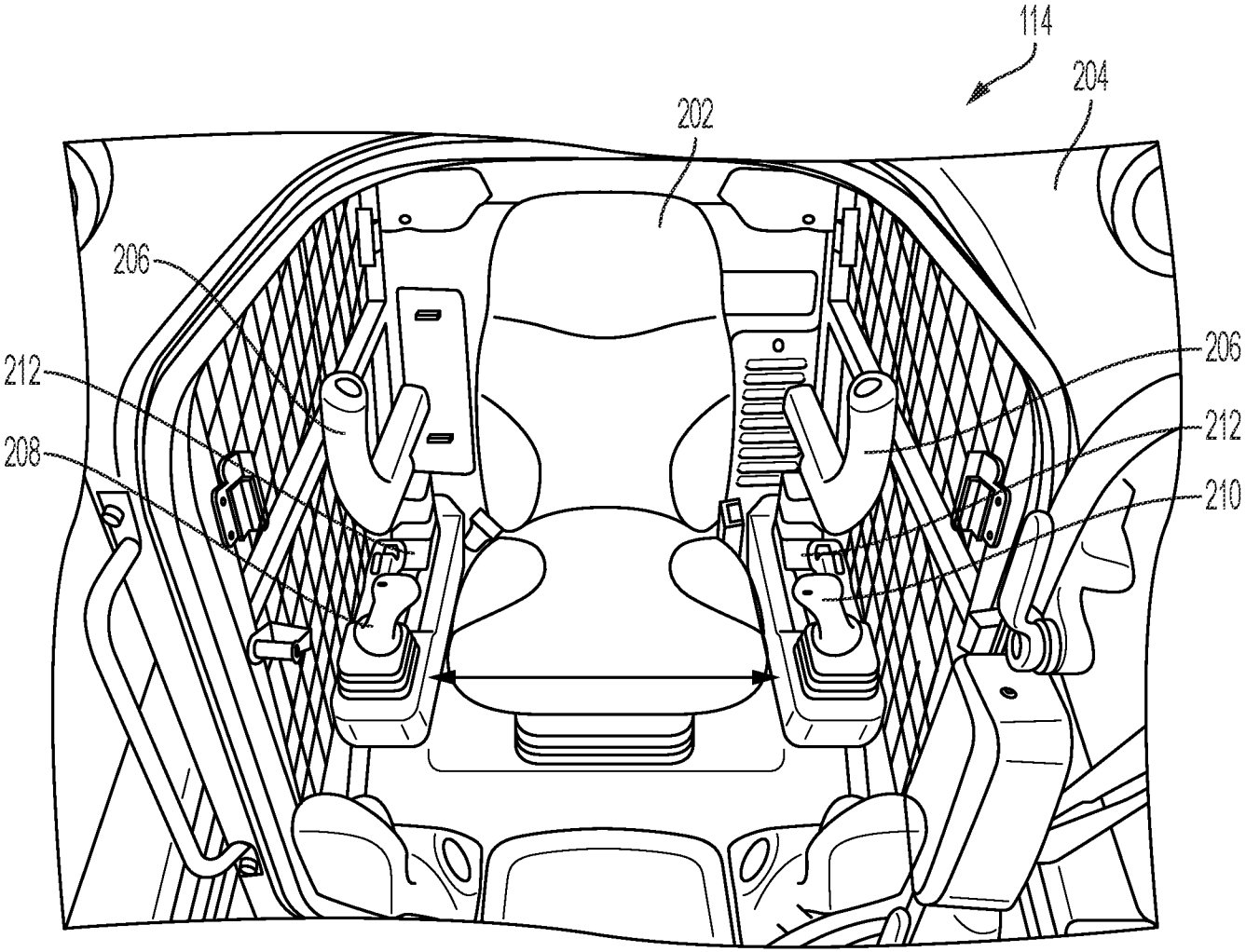
FIG. 2 is a partial view of an operator cab for a machine in accordance with the disclosure.

The machine 100 further includes an operator cab 112, which encloses an operator area 114. As can be appreciated, other machine types may omit the operator cab and/or its enclosure altogether. An outline detail view of the operator area 114 is also shown in FIG. 2. In reference to FIGS. 1 and 2, the operator area 114 in the illustrated, exemplary embodiment includes a seat 202 disposed within an enclosure 204. The seat 202 is optional and can be replaced by a standing platform in a different machine type, for example, an asphalt paver, forklift, and others. The enclosure, roll bars, and the like may also be omitted depending on machine type. In the embodiment shown, the seat is flanked by two retention bars 206, which pivot towards the user when seated to help support and retain the operator during machine operation. The bars 206 may also act as safety devices to lock out machine operation when open to ensure that machine operation occurs while the operator is seated to avoid injury to the operator.

Figure 4:
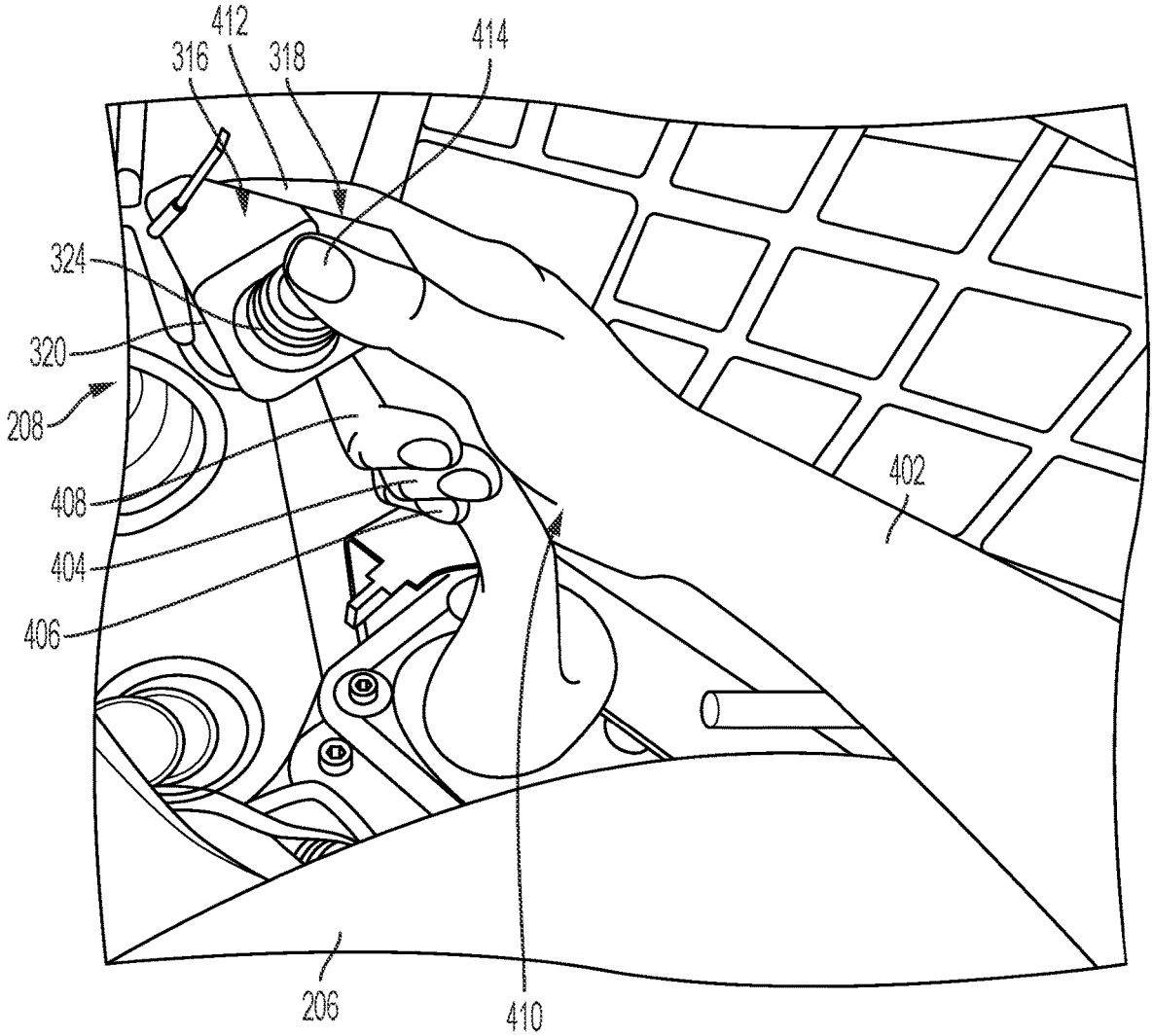
FIG. 4 is a partial outline view of a manual control device during operation by a user in accordance with the disclosure.

When seated, the operator (not shown) controls motion and operation of the machine by manipulating two manual input devices, a first manual input device 208 disposed on the right side of the seated operator, and a second manual input device 210 disposed on the left side of the seated operator. During machine operation, the seated operator can grab and manipulate the first manual input device 208 with the operator's right hand 402, as shown in FIG. 4, and the second manual input device 210 with the operator's left hand (not shown). The first and second manual input devices 208 and 210 are mounted onto armrests 212 disposed laterally on either side of the seat 202. The first and second manual input devices 208 and 210 may have similar or identical construction but be planarly symmetrical or mirror images of one another for symmetrical placement on either side of the seat 202. The planar symmetry of the two devices permits ease of use for the operator and also ambidextrous arrangement of machine operation and controls that can be tailored to right- or left-handed operators with ease.

Figure 3:
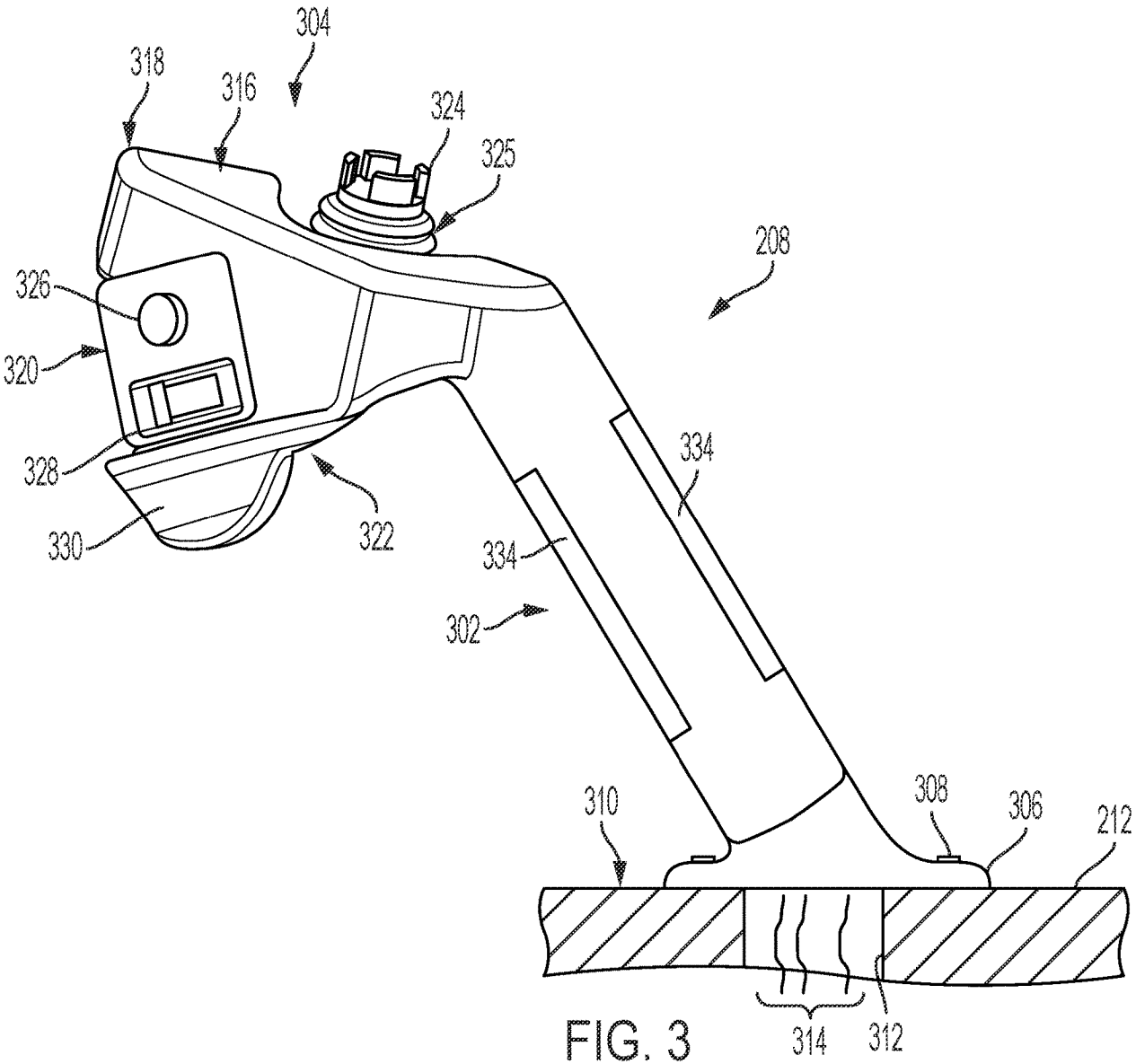
FIG. 3 is a partial outline view from a side perspective of a manual control device in accordance with the disclosure.
Figures 5A, 5B:
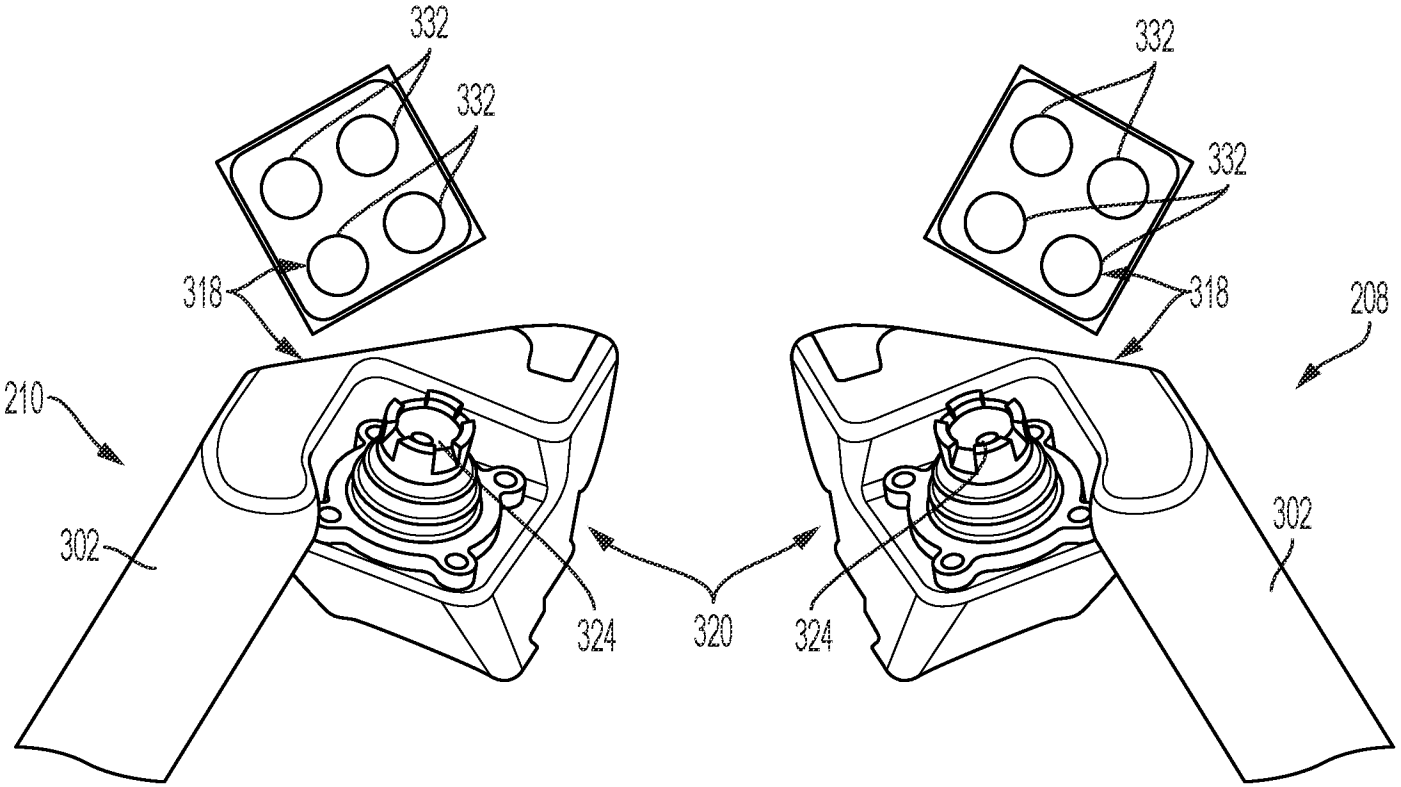
FIGS. 5A and 5B are partial outline views of a pair of manual control devices in accordance with the disclosure.

An outline view of the first manual input device 208 is shown removed from the machine 100 in FIG. 3, and a close-up view thereof is shown in FIG. 4. As shown in FIGS. 5A and 5B, the second manual input device 210 may be arranged in a similar or same manner as the first manual input device 208. In the description that follows, description of features or structures relative to the first manual input device 208 will also apply to the second manual input device 210.

In reference to these figures, it can be seen that the first (or second) manual input device 208 incudes a handle portion 302 and a control portion 304. The handle portion 302 has a generally elongate shape and is rigidly attached to the armrest 212 of the machine 100 at one end. In the illustrated embodiment, the handle portion 302 includes a rigid mounting flange 306 that is rigidly connected with fasteners 308 to an upper surface 310 of the armrest 212. The armrest 212 may include an opening, passage or channel 312 that accommodates electrical conductors 314 to interconnect various switches, sensors and controls (not shown) included in the first manual input device 208 to be connected with a machine controller, for example, the machine controller 108 (FIG. 1). Manipulation of various control surfaces on the first manual input device 208 by the operator are translated into control signals that are provided to the controller 108 to carry out various machine functions, in the known manner. The unique aspects of the manual input devices 208 and 210 over known devices such as joysticks lie in the overall construction of the manual input devices, as described hereinafter. For example, where most known joystick controllers have a base that pivotally supports a moveable shaft that is grasped by the operator, in the manual input devices 208 and 210, at least a portion of the handle portion 302 grabbed by the operator is rigidly connected or mounted relative to the machine.

More specifically, the handle portion 302 adapted or arranged to be grabbed by at least two fingers, or in alternative embodiments and at the option of the user, grabbed with three or four fingers, as shown in FIG. 4. When the operator's hand 402 engages the first manual input device 208, at least the operator's ring finger 404 and little finger 406 can wrap around the handle portion 302. Optionally, the middle finger 408 can also wrap around the handle portion 302. When not used to control machine functions, the handle portion 302 may also accommodate the operator's index finger wrapped around the handle portion 302. In a grip similar to that of a gun handle, the operator's palm 410 can be pressed, secured or stabilized against the handle portion 302 by the aforesaid three fingers, to stabilize the operator's hand relative to the handle portion 302, which also stabilizes the operator's hand and the operator in general to the armrest 212, the seat 202, and the machine 100 in general given the rigid mounting of the handle portion 302 to the armrest 212. Of course, suspension and vibration dampeners that may be included in the machine to mount the seat will not appreciably detract from the operator's stable position and stance relative to the machine and, further, will not affect the operator's hand stability relative to the manual input device 208 because the operator can maintain a positive grip onto the handle portion 302 at all times during operation.

The three-finger grip of the handle portion 302 advantageously frees the operator's index finger 412 and thumb 414 to move and control various inputs and switches while the operator's hand remains engaged and grabbing the handle portion 302. As shown in the figures, and in particular FIG. 3, and FIGS. 5A and 5B, it can be seen that the manual input device 208/210 includes numerous control input devices that can be assigned to perform various functions on the machine by the controller 108. In the illustrated embodiment, the control input devices are arranged around a control portion 304, which is connected to the handle portion 302 at one end, or at its free end opposite the connection of the handle portion 302 to the armrest 212 in the embodiment shown. In alternative embodiments, the handle portion may be suspended from its top in a generally vertical configuration, or from its side in a generally horizontal configuration, similar to a bicycle handle, in which case the handle portion may be supported by the control portion, which control portion is rigidly connected to the machine frame. In the embodiment shown here, the control portion 304 is connected to a free end of the handle portion 302 and is shaped for finger access of the operator's hand so that the index finger and the thumb can activate control input surfaces and switches. In the illustrated embodiment, the control portion 304 includes a top side 316, an outboard side 318, an inboard side 320, and a bottom side 322.

Because of the way the index finger and thumb can be moved while the remaining fingers and palm engage the handle portion 302, the top side 316 and inboard sides 320 are accessible using the thumb 414 (FIG. 4) and include a first plurality of control surfaces, and the outboard side 318 and bottom side 322 are accessible using the index finger 412 (FIG. 4) and include an optional second plurality of control surfaces. In reference to FIG. 3, the top side 316 includes a thumb-stick 324, which can be formed similar to a gaming controller stick, and which is movable and pivots relative to the control portion 304 in at least four ordinal directions, as well as four more diagonal directions. As can be appreciated, the thumb-stick 324 can be gated in any desired configuration to move anywhere within a circle, square, diamond or polygonal area such that multiple directions can be activated at once. The thumb-stick 324 can be operated using the thumb to move in various directions. Motion of the thumb-stick 324 in any direction is translated using sensors 325, which are integrated with the control portion 304 and connected to the conductors 314. In alternative embodiments, the conductors may be omitted and replaced with wireless signals sent from the sensors to a machine controller. In the embodiment shown, the conductors 314 extend from the sensors 325, and other sensors and/or transducers associated with other control surfaces in the control portion 304, through the handle portion 302, and into the frame 12, for example, through channel 312 formed in the armrest 212, which is part of the frame 112 for purpose of the present discussion and for simplicity, to reach the machine controller 108 (FIG. 1). In alternative mounting configurations of the handle portion, as described above, the conductors may extend through the control portion and avoid the handle portion when being routed into the frame. In the exemplary embodiment described here relative to a skid steer loader, the thumb-stick 324 on the first manual input device 208 located on the operator's right side can be used for lifting and tilting the bucket 102, while the thumb-stick 324 on the second manual input device 210 can be used to drive, move or turn the machine in any desired direction. These control inputs can also be reversed or reversible based on the operator's preference.

The inboard side 320 may also include buttons, switches and other control inputs to perform various other functions that are accessible using the operator's thumbs 414. Any desired control input device type can be used, for example, buttons, switches, rollers and the like can be used. In the illustrated embodiment, the inboard side 320 of the first manual input device 208 includes a button 326, which activates a horn, and a slider 328, which controls the proportional power provided to an auxiliary tool installed in place of the bucket 102, for example, a planer. The bottom side 322 includes a trigger 330 which activates a float mode function upon being depressed, which allows the bucket or other work implement to slowly rest on the ground and/or follow the contour of the ground without digging in. In an alternative embodiment, the trigger 330 may be a static structure used as a finger rest for the operator's index finger. The outboard side 318, may include any other functional input that the machine and/or any attached work tools require. As shown, the configurable inputs on the outboard side include four buttons 332, which can be assigned to particular functions by the controller 108 depending on the type of work implement that is attached to the machine.

In an optional embodiment, the manual control devices 208/210 may further include a safety device in the form of an operator presence switch or sensor 334. In the embodiment shown, the sensor 334 is integrated with the handle portion 302 and, through spring-loaded pads or a touch sensor, provides a signal indicative of the operator's hand being present and grabbing the handle portion 302 using at least two fingers, as previously described and as shown in FIG. 4. In this embodiment, two sensors 334 are used on the forward and aft directions of the handle, which align generally with the operator's forearm and sense whether a palm is touching the aft end and whether fingers are curled around at least a portion of the forward end of the handle portion. The signal(s) from the sensor(s) 334 may be provided to the controller to ensure safe operation of the machine during performance of different tasks. For example, if the second manual input device 210 is used for moving the machine, the controller may halt motion of the machine if the sensors 334 on the second manual input device 210 indicate that the operator has let go of the handle portion 302. Similar other functions can also be performed, such as disabling lifting a bucket when the operator releases the manual input device that includes bucket controls, or slowing the machine travel speed when travelling over rough terrain when the operator is not holding onto the two handle portions 302, and so forth.

INDUSTRIAL APPLICABILITY

Figure 6:
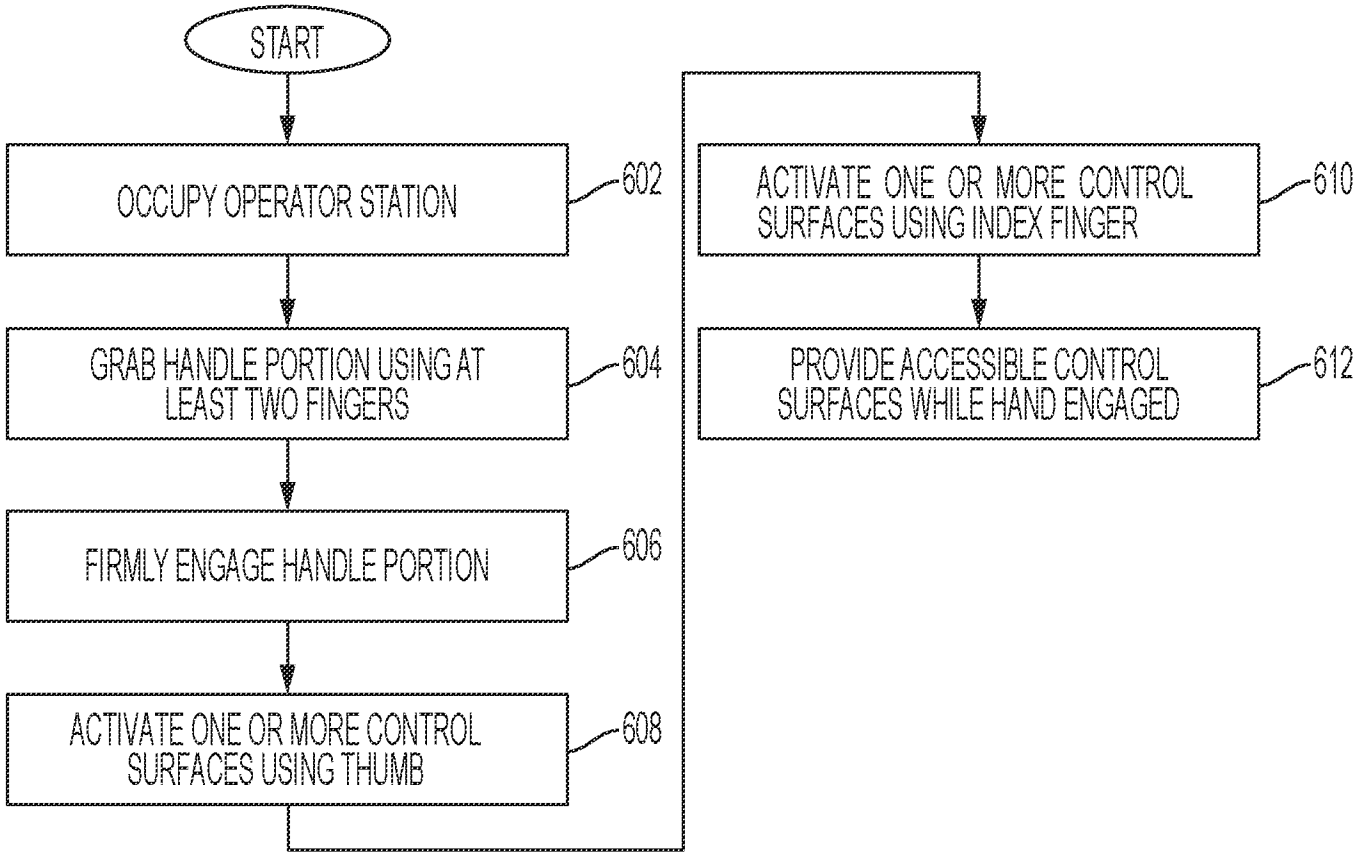
FIG. 6 is a flowchart for a method of operating a machine in accordance with the disclosure.

The present disclosure is applicable to manual control input devices for machines in which stability of the operator may be advantageous to the precise or safe operation of a machine. A flowchart for a method of operating a machine in accordance with the disclosure is shown in FIG. 6. In accordance with the method, an operator occupies an operator station of a machine at 602. The operator uses at least one hand to grab a handle portion of a control device, which is rigidly connected to the machine, using at least two fingers, at 604. The operator may tighten a grasp by curling the at least two fingers around the handle portion such that the operator's hand is firmly in engagement with the handle portion at 606. The operator may then activate one or more control surfaces using the operator's thumb at 608 and, similarly, may operate one or more additional control surfaces using the operator's index finger at 610. The one or more control or additional control surfaces are provided on a control portion of the manual input device that is accessible by the operator's index finger and/or thumb, while the operator's remaining hand portions are firmly engaged with the handle portion at 612.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A machine, comprising:

a frame having a controller associated therewith;

an operator station disposed on the frame, the operator station adapted to be occupied by an operator during operation of the machine;

a manual input device connected to the frame, the manual input device configured to be engaged by a hand of the operator, wherein the manual input device includes:

a handle portion having an elongate shape and a bottom surface rigidly connected to the frame;

a control portion connected to the handle portion and including an upper surface that is substantially planar and that faces away from the bottom surface;

an outboard side of the control portion facing away from the handle portion and substantially orthogonal to the upper surface; and a first plurality of control surfaces and a second plurality of control surfaces, the first plurality of control surfaces and the second plurality of control surfaces being associated with sensors providing control signals to the controller;

wherein the first plurality of control surfaces is accessible for interaction by a thumb of the hand of the operator, wherein the second plurality of control surfaces is accessible for interaction by an index finger of the hand of the operator, and the first plurality of control surfaces includes at least one control surface provided on the upper surface, and the second plurality of control surfaces includes at least one control surface provided on the outboard side of the control portion.

2. The machine of claim 1, wherein the controller is disposed to control an operation of one or more systems of the machine in response to the control signals, and wherein the control signals are provided to the controller through conductors extending from the control portion to the controller at least partially through the frame.

3. The machine of claim 2, further comprising a work implement attached to the frame, wherein the controller is configured to assign a movement function to a control surface belonging to the first plurality of control surfaces, and a power or mode function to an additional control surface belonging to the second plurality of control surfaces.

4. The machine of claim 1, further comprising a work implement attached to the frame, wherein the manual input device is a first manual input device, and wherein the machine further comprises a second manual input device attached to the frame, wherein the first manual input device is configured to control a movement of the machine, and wherein the second manual input device is configured to control a movement of the work implement.

5. The machine of claim 1, further comprising a handle sensor disposed along the handle portion, the handle sensor operating to provide a signal indicative of a presence of the hand of the operator in engagement with the handle portion.

6. The machine of claim 1, wherein the operator station includes a seat or a standing platform, the control portion includes a top side having the upper surface, a bottom side, and an inboard side which is closer to the seat or the standing platform than the outboard side, wherein the bottom side of the control portion includes at least one of a trigger or a finger rest.

7. The machine of claim 6, wherein the first plurality of control surfaces includes a slider arranged along the inboard side of the control portion.

8. The machine of claim 6, wherein the second plurality of control surfaces includes a plurality of buttons arranged along the outboard side of the control portion.

9. The machine of claim 1, wherein the first plurality of control surfaces includes a thumb-stick provided on the upper surface, wherein the thumb-stick is movable in at least four different directions.

10. The machine of claim 1, wherein:

the operator station includes a seat, the manual input device is a first manual input device provided at a first side of the seat, the machine further comprises a second manual input device attached to the frame and provided at a second side of the seat, and wherein an inboard side of the control portion of the first manual input device faces the seat.

11. The machine of claim 10, wherein the outboard side of the control portion of the first manual input device faces away from an outboard side of a control portion of the second manual input device.

12. The machine of claim 1, further comprising a work implement, the work implement including at least one of a loading bucket, a planer, a mower, an auger, or a snow blower, wherein the first plurality of control surfaces are configured to control a movement of the work implement, and the second plurality of control surfaces are configured to control a power to or mode of the work implement.

13. A manual input device for a machine, comprising:

a handle portion having an elongate shape, the handle portion having one end configured to be rigidly connected to a frame of the machine, the handle portion being configured to be engaged by a hand of an operator;

a control portion connected to the handle portion and configured to be connected to the frame in a cantilevered manner via the handle portion, the control portion including a first plurality of control surfaces and a second plurality of control surfaces, the first plurality of control surfaces and the second plurality of control surfaces being associated with sensors providing control signals to a controller of the machine;

wherein the first plurality of control surfaces is positioned and oriented relative to the handle portion so that at least one control surface of the first plurality of control surfaces is accessible for interaction by a thumb of the hand of the operator, and wherein the second plurality of control surfaces is positioned and oriented relative to the handle portion so that at least one control surface of the second plurality of control surfaces is accessible for interaction by an index finger of the hand of the operator, wherein the second plurality of control surfaces includes a control surface that is disposed on a bottom side surface that faces downward and the first plurality of control surfaces includes a thumb-stick that is movable with respect to the control portion in at least four different directions.

14. The manual input device of claim 13, further comprising a handle sensor disposed along the handle portion, the handle sensor operating to provide a signal indicative of a presence of the hand of the operator in engagement with the handle portion.

15. The manual input device of claim 13, wherein the control portion includes a top side, a bottom side that includes the bottom side surface, an inboard side, and an outboard side, the handle portion being rigidly connected to an armrest of the frame below the bottom side.

16. The manual input device of claim 15, wherein the first plurality of control surfaces is arranged along the top side and the inboard side of the control portion, wherein the thumb-stick is arranged along the top side.

17. The manual input device of claim 15, wherein the second plurality of control surfaces is arranged along the bottom side and the outboard side of the control portion.

18. The manual input device of claim 13, wherein the thumb-stick is movable in a circle.

19. A method for controlling a machine, comprising:

controlling movement of the machine and/or movement of one or more implements of the machine based on a movement of a first plurality of control surfaces of a control device, wherein the first plurality of control surfaces is disposed on a control portion of the control device that is connected onto a free end of a handle portion of the control device, wherein the handle portion of the control device is rigidly connected to a frame of the machine in a cantilevered manner via the handle portion, wherein the first plurality of control surfaces are accessible for interaction by a thumb of an operator, and wherein the first plurality of control surfaces includes a thumb stick that is on an upper surface of the control portion that is substantially planar, the thumb stick being movable with respect to the control portion in at least four different directions; and controlling a power to and/or a mode of the one or more implements based on an interaction with a second plurality of control surfaces disposed on the control portion, including a control surface extending from a bottom side of the handle portion and a control surface on an outboard side of the control portion that is substantially orthogonal to the upper surface, wherein the second plurality of control surfaces is accessible by an index finger of the operator.

20. The method of claim 19, wherein the control portion has a top side and an inboard side in addition to the bottom side and the outboard side, and the mode is a float mode of the one or more implements that is controlled based on the interaction with the control surface extending from the bottom side, wherein the first plurality of control surfaces is arranged along the top side and the inboard side, and wherein the second plurality of control surfaces is arranged along the bottom side and the outboard side.

* * * * *